US007433644B2

(12) United States Patent
Lundy et al.

(10) Patent No.: US 7,433,644 B2
(45) Date of Patent: Oct. 7, 2008

(54) BLADE BRUSH CLEANER

(75) Inventors: Douglas Lundy, Webster, NY (US); D. Clay Johnson, Rochester, NY (US); Bruce J. Parks, Bloomfield, NY (US); Michael Lu, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 306 days.

(21) Appl. No.: 11/338,547

(22) Filed: Jan. 24, 2006

(65) Prior Publication Data

US 2007/0172274 A1 Jul. 26, 2007

(51) Int. Cl.
*G03G 21/00* (2006.01)

(52) U.S. Cl. ..... 399/349; 399/355

(58) Field of Classification Search ..... 399/343, 399/349, 350, 353, 355; 15/1.51, 256.52
See application file for complete search history.

(56) References Cited

U.S. PATENT DOCUMENTS

| | | | | |
|---|---|---|---|---|
| 5,264,904 | A * | 11/1993 | Audi et al. | 399/71 |
| 6,895,209 | B2 * | 5/2005 | Kawahara et al. | 399/353 |
| 7,078,142 | B2 * | 7/2006 | Itami et al. | 430/119.72 |
| 7,233,755 | B2 * | 6/2007 | Tango et al. | 399/175 |

* cited by examiner

*Primary Examiner*—Hoan H Tran
(74) *Attorney, Agent, or Firm*—Gary B. Cohen

(57) ABSTRACT

A photoconductor belt cleaning system is described. This system can utilize in one embodiment one cleaning brush and a cleaning blade, and in a second embodiment, two cleaning brushes, brush 1 and brush 2, with a cleaning blade. In the second embodiment, the cleaning blade is located in the system before brush 2, and adjacent to brush 1. The brushes are charged in an opposite polarity to the charge of the toner to be removed from the photoconductor belt.

6 Claims, 3 Drawing Sheets

BLADE BRUSH CLEANER

FIELD

This invention relates to an electrophotographic process, and more specifically to a photoconductor cleaning system useful in said process.

BACKGROUND

In Xerography or an electrostatographic process, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner being electrostatically attached to the latent electrostatic image areas to create a visible replica of the original. The developed image is then usually transferred from the photoreceptor surface to a final support material, such as paper, and the toner image is fixed thereto to form a permanent record corresponding to the original.

In some Xerographic copiers or printers, a photoreceptor surface is generally arranged to move in an endless path through the various processing stations of the xerographic process. Since the photoreceptor surface is reusable, the toner image is then transferred to a final support material, such as paper, and the surface of the photoreceptor is prepared to be used once again for the reproduction of a copy of an original. In this endless path, several Xerographic related stations are traversed by the photoconductive belt.

Generally after the transfer station, a photoconductor cleaning station is next and it comprises an endless photoconduction belt which passes sequentially to a first cleaning brush, a second cleaning brush and after the brushes are positioned, a spots blade which is used to remove residual debris from the belt such as toner additive and other filming. This film is generally caused by the toner being impacted onto the belt by the cleaner brushes. When the lubrication of this blade is below a necessary level, it will abrade the belt. Toner is the primary lubricant for the blade; however a problem is with good cleaning efficiency by the cleaner brushes, the amount of toner reaching the blade can often be well below this necessary level. Without proper lubrication, this spots blade will seriously abrade the belt.

Since most toners used today are negatively charged, the embodiments throughout this disclosure and claims will be described relating to the use of a negative toner, however, when a positive toner is used, the proper opposite adjustments can easily be made.

The first brush above mentioned in prior art systems is responsible for nearly all of the filming on the photoconductive (PC) belt. This brush is positively charged to attract a negative charged toner and remove most of it from the PC belt. Adjacent to the first brush is a vacuum which vacuums the toner from the brush for later disposal. Any toner that may have acquired a positive charge will pass by the first positively charged brush and will be picked up by the second brush which is negatively charged. The vacuum is also adjacent to the second brush and should vacuum off the brush any residual positively charged toner. Then, as above noted, the spots blade scrapes off the belt any remaining toner debris or film layer. Again, after the action of the two prior cleaning brushes there is generally not sufficient toner lubrication for an effective action by this spots blade. The spots blade will remove the film layer comprised of toner additives that is caused by the impact of the first brush against the toner and PC belt. The serious problem that has been encountered in this type of prior art arrangement is, as noted, that the spots blade does not get enough toner provided lubrication and can easily scratch and damage the belt, causing a relatively high replacement rate for both the belt and the spots blade. In addition, copy quality begins to deteriorate as the PC belt is abraded and damaged or as the film is less effectively removed from the PC belt.

SUMMARY

In an embodiment of the invention, a cleaning blade replaces the first brush used in the prior art, thereby providing a way for the cleaning blade to receive generous lubrication and at the same time remove from the belt all or nearly all of the toner. Since in this first embodiment this cleaning blade is sequentially the first component in the cleaning system, it has the proper amount of toner providing lubricant to greatly reduce the abrasion of the PC belt. Loosened toner is transported away by airflow via a vacuum channel positioned near the cleaning blade. An electrostatic cleaning brush (positively charged) follows the blade to remove any residual toner that passes the cleaning blade. This brush is detoned via a flicker bar and airflow vacuuming. With zero or substantially zero toner reaching the brush, additive filming is no longer a problem. The cleaning blade contacts the photoconductive belt at an angle suitable to effectively remove most toner. By using this first embodiment and a second embodiment described below, the life of the PC belt has been extended to at least twice its normal life, saving a substantial replacement cost for not only the belt but also for the spots blade. The cleaning blade is made of materials that will effectively remove toner with the minimum abrasion of the belt; including material such as urethanes, nylon or any other suitable material. The cleaning brush can be made from known cleaning brush materials including acrylics, nylons and other suitable materials that have been treated to provide electrical conductivity. In this embodiment an entry shield is placed below the cleaning blade to catch any loosened toner falling from the blade and direct it to a vacuum air flow channel where it is transported away. Obviously, the brush bias can be optimized for the species of toner passing the blade. A preclean charging treatment can be used to precharge the toner to an optimal level for brush and blade removal. Excellent results using the present and later defined embodiments over extended runs have been demonstrated.

By eliminating the first cleaning brush in this one embodiment and the spots blade of the prior art and replacing them with a cleaning blade, has provided an unexpectedly efficient and effective belt cleaning system, thereby reducing substantially the PC belt replacement rate.

In a second embodiment of the cleaning system described herein, two cleaning brushes are used and a cleaning blade is positioned adjacent to the first brush. The first brush is charged in a manner that allows ample toner to pass through to the blade tip thus ensuring adequate lubrication at all times. The first brush is also used to transport toner from the blade tip to the vacuum channel. This second embodiment is further discussed in reference to FIG. 2 below described.

To summarize the first embodiment above described there is provided a photoconductive (PC) belt cleaning system comprising in an operative arrangement a photoconductive belt, a cleaning blade, a vacuum unit, and an electrostatic cleaning brush. The PC belt is adapted to move sequentially to said cleaning blade, then to said electrostatic cleaning brush. The cleaning brush has an electrostatic charge opposite to a charge of a toner used in said system. The cleaning blade is in operative toner cleaning contact with said PC belt and enabled to scrape off toner from said belt. The electrostatic cleaning brush is enabled to attract and to remove oppositely charged toner from said PC belt. The cleaning blade is movably positioned in contact with said PC belt at an angle sufficient to allow said blade to remove toner from said belt. This angle is about from 5 to 30 degrees, based on the surface of the PC belt. The vacuum unit is in vacuuming relationship to both said electrostatic brush and said cleaning blade and is enabled to draw via airflow channel any loosened toner removed by said brush and said blade. The blade has positioned below it an entry shield enabled to capture loose toner falling from said blade. The brush is additionally detoned by a flicker bar in operative contact therewith.

To summarize the second embodiment above described, there is provided a PC belt cleaning system comprising in an operative arrangement a cleaning blade, two electrostatically charged brushes, the first brush has a negative charge and operatively located adjacent said cleaning blade. The second brush has a positive charge and is located in the system after said first brush and said cleaning blade. An entry shield is positioned below the first brush to capture loose toner falling from the brush or blade. The impact aspect in both embodiments and any other, is that the cleaning blade be positioned in the cleaning system so that it gets proper toner lubrication to function effectively.

DETAILED DISCUSSION OF DRAWINGS AND PREFERRED EMBODIMENTS

Figure 1:
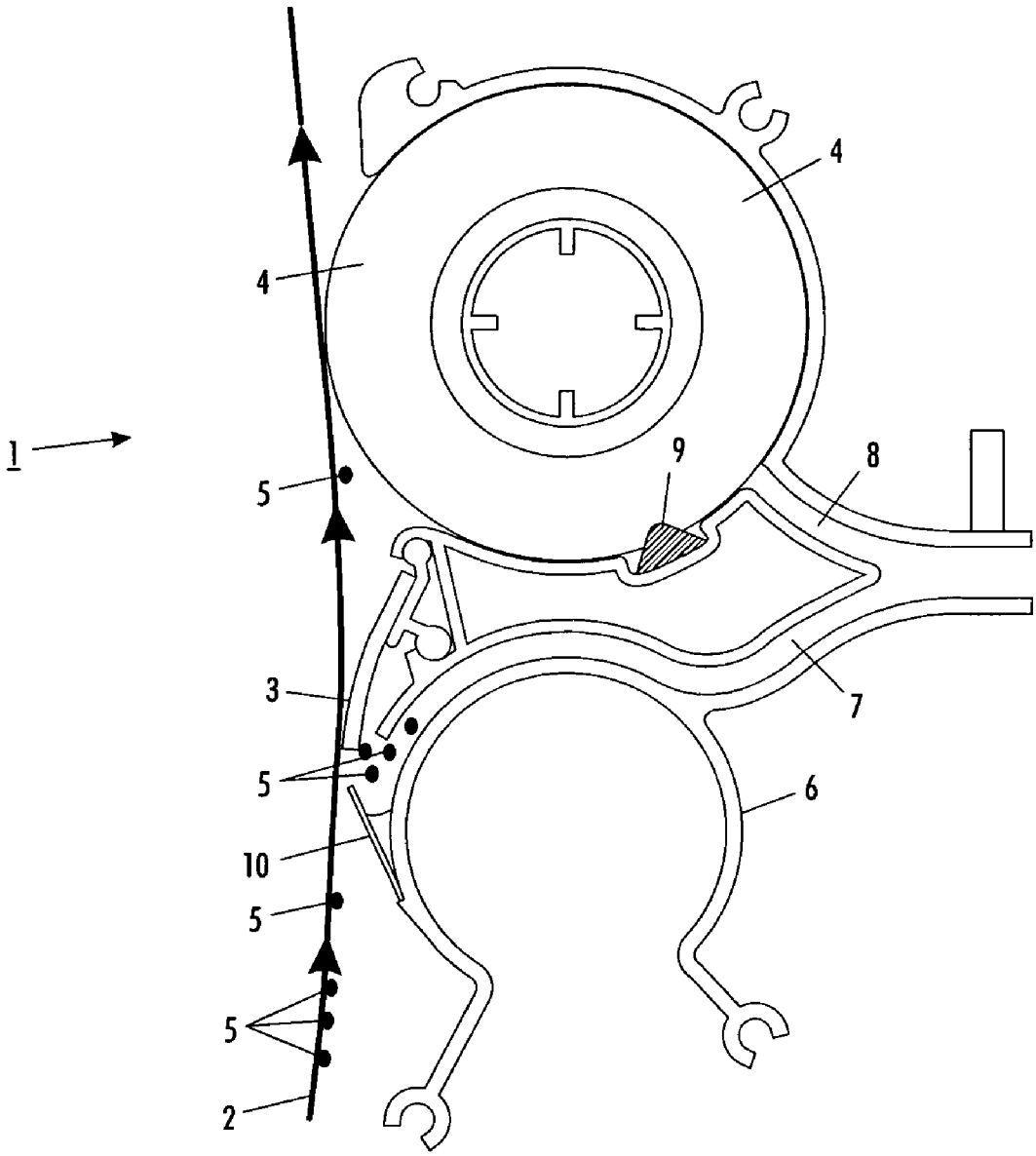
FIG. 1 illustrates an embodiment of the cleaning system herein described.

In FIG. 1, cleaning system 1 of an embodiment, a photoconductive belt 2 is shown as it is adapted to move sequentially first to the cleaning blade 3, and then to an electrostatic brush 4. The arrows show the direction and path of the PC belt. The blade 3 is therefore upstream from the brush 4 and is the first cleaning component that contacts the belt. In this position blade 3 gets the proper toner induced lubrication since toner has not been previously removed by a brush 4 or any other component. The electrostatic brush 4 has a charge on it that is opposite to the charge on the toner 5 used in the system. This will permit brush 4 to attract the opposite charged toner 5 and remove any residual toner 5 not removed from the PC belt 2 by the cleaning blade 3. As above stated, since the cleaning blade 3 is the first cleaning component contacted by the belt 2, there is sufficient toner 5 on the belt at that point to provide ample lubrication for the blade 3 and minimize abrasion of the belt 2. The electrostatic brush 4 in system 1 follows the blade 3 to remove any residual toner 5. A vacuum unit 6 is positioned between the blade 3 and brush 4 to vacuum off any loose toner removed by either blade 3 and brush 4. After the toner is vacuumed out it can be disposed of by any suitable method. Vacuum air channels 7 and 8 are in air flow contact with the blade 3 and brush 4 respectively. A flicker bar 9 is in operative contact with brush 4 and is adapted to detone brush 4 together with vacuum unit 6. As toner 5 is flicked off brush 4 by flicker bar 9, it is picked up by the suction of vacuum channel 8 and transported out of system 1. Flicker bar 9 is positioned such that the fibers in the rotation brush 4 will contact the flicker bar 9 prior to reaching the vacuum channel 8; in FIG. 1, the flicker bar 9 is shown in a position consistent with a counterclockwise brush 4 rotation. Clockwise brush 4 rotation can also be used with the flicker bar 9 in a suitable position. An entry shield 10 is located below the cleaning blade 3 and directs loosened toner into vacuum channel 7 for removal from system 1. Toner 5 therefore is sequentially removed from photoconductor belt 2 by first contact with blade 3 which scrapes toner 5 off belt 2 and then by cleaner brush 4 which removes any residual toner by brush action together with electrostatic action (since it is biased oppositely to toner). The arrows 11 indicate the travel direction of belt 2, blade 3 is "upstream" and brush 4 is "downstream" as used in this disclosure.

Figure 2:
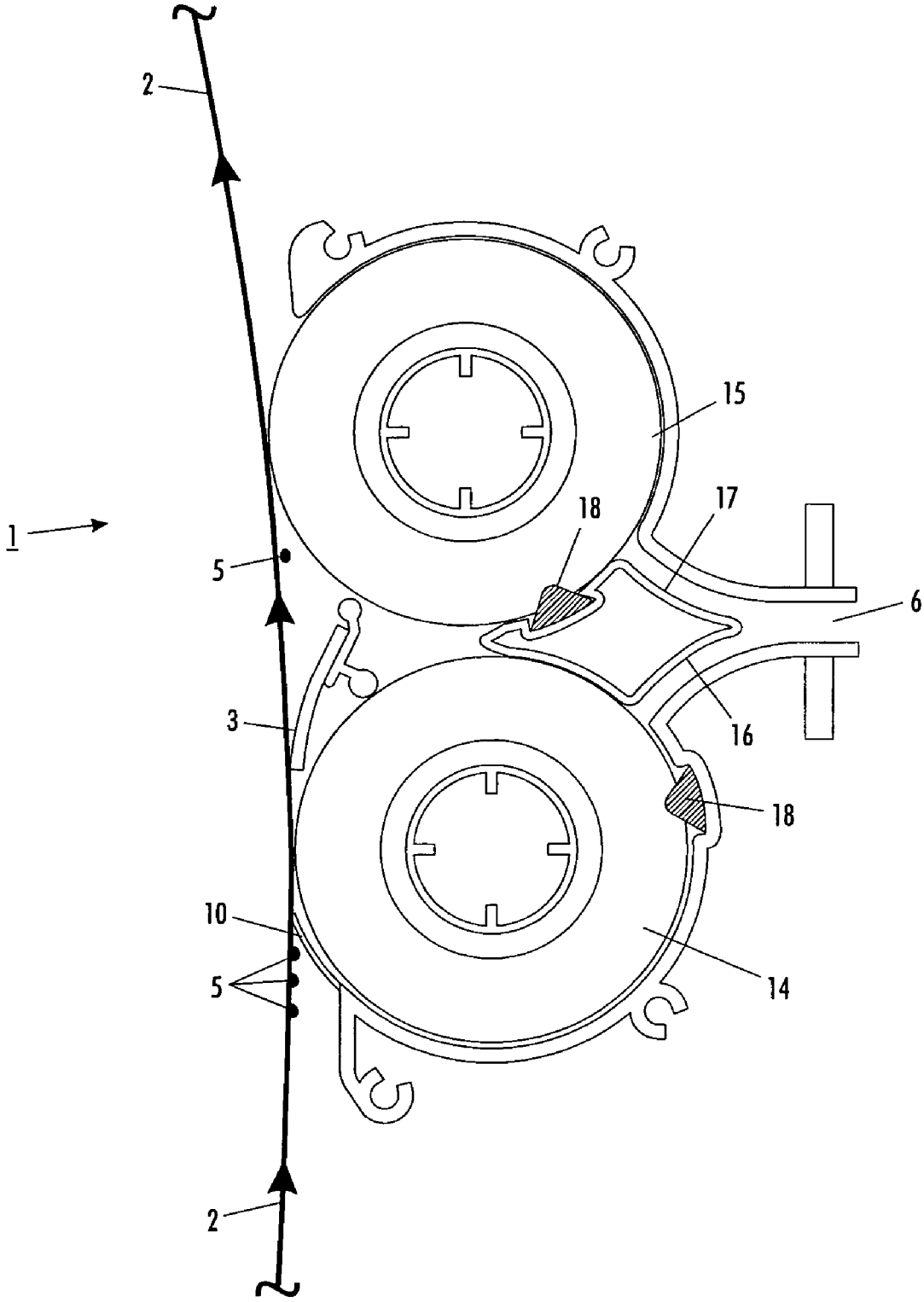
FIG. 2 illustrates a second embodiment of the cleaning system herein described.

In FIG. 2, a second embodiment of the cleaning system described herein is illustrated. Two brushes 14 and 15 are used and a cleaning blade 3 is positioned adjacent to the first brush 14. The first brush 14 is charged in a manner that allows ample toner 5 to pass through to the blade tip 3, thus ensuring adequate lubrication at all times. A negative charge on the first brush 14 would remove any toner 5 that acquired a positive charge and allow all of the negatively charged toner 5 to pass through to the blade tip 3. Alternatively, a low positive charge on the first brush 14 would enable some level of cleaning of negatively charged toner 5 from the PC belt 2, if so desired, depending on the operating conditions at a given point in time. In either case, positive or negative charging of the first brush 14, the charge level would be such that ample toner is allowed to pass through to the blade tip 3. The first brush 14 is also used to transport toner 5 from the blade tip 3 to the vacuum channel 16. Another vacuum channel 17 is used to transport any residual loosened toner 5 from the second brush 15 to a vacuum collection means where it is disposed of. The second brush 15 can be charged positively or negatively to complement the polarity of the first brush 14. If the first brush 14 is negative to remove positively charged toner 5, the second brush 15 is positive to remove negatively charged toner 5 that was not removed by the blade tip 3. If the first brush 14 is positive to remove some negative toner 5, the second brush is negative to remove positively charged toner 5 that is not removed by the blade tip 3. If the Xerographic system is optimized in a manner to ensure only one polarity of toner arrives at the cleaning system 1, then both brushes 14 and 15 can be charged to the same polarity, that being opposite of the toner 5 polarity. The charge level on the first brush 14 would still be such that an ample amount of lubricating toner 5 would pass through to the blade tip 3. The flicker bars 18 positions are suitable for brushes that are rotating in a counter clockwise direction. The brush fibers hit the flicker bar 18 which compresses the fibers. Then as the fibers open up, they are exposed to the vacuum channels 16, 17 for toner removal. Obviously, if the brushes 14 and 15 were rotating clockwise, the flicker bars 18 would be shown in a different location (preceding the vacuum channels 16 and 17). An entry shield 10 is positioned below the first brush 14 to capture loose toner 5 falling from the brush 14 or blade 3.

Figure 3:
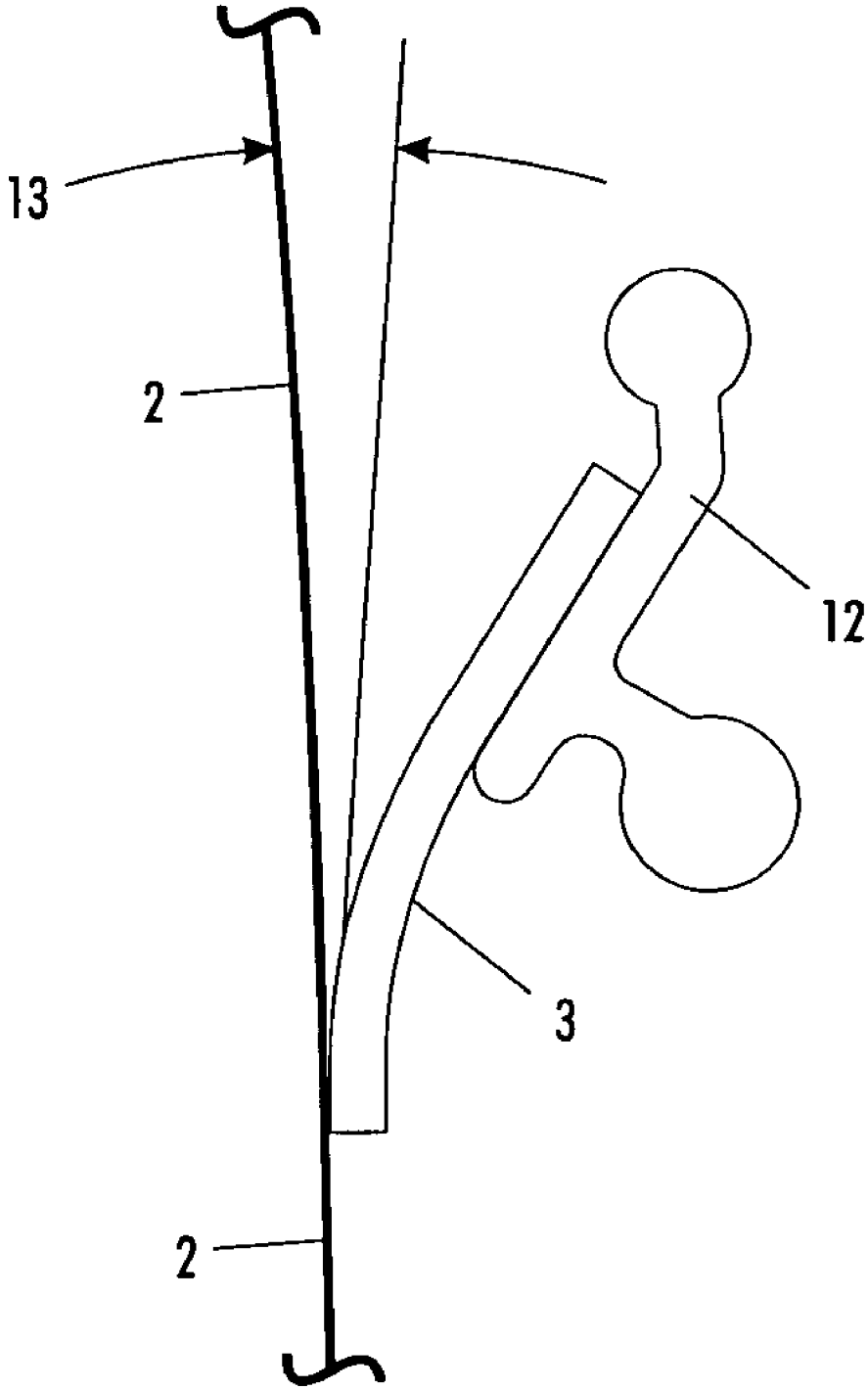
FIG. 3 illustrates an embodiment of the movable cleaning blade as it contacts the photoconductive belt.

In FIG. 3, the cleaning blade 3 of an embodiment is shown in an expanded view as it contacts PC belt 2. A movable or floating support 12 for the cleaning blade 3 permits proper movement and support for blade 3 as it contacts PC belt 2. While any suitable angle of contact 13 between the PC belt 2 and the blade 3 may be used, an angle of from 5 to 30 degrees has been found to be effective, however, any suitable and effective angle may be used. This system of FIG. 3 can be used in the embodiments of FIGS. 1 and 2 and any other embodiments.

Described above are photoconductive (PC) cleaning systems comprising in an operative arrangement, a movable PC belt, at least one electrostatically charged cleaning brush, and a cleaning blade. The cleaning blade is positioned upstream in said system and located therein prior to one electrostatically charged brush, said PC belt is adapted to travel to said cleaning blade before it contacts a later cleaning brush positioned in said system subsequent to said cleaning blade. The cleaning blade is adapted to scrape toner off said PC belt and be lubricated by said toner prior to contacting said later brush. At least one of said electrostatically charged brush present in said system will remove charged toner from said PC belt.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A cleaning system comprising in an operative arrangement, a movable photoconductive belt, an electrostatically charged cleaning brush, and a cleaning blade, said cleaning blade positioned upstream in said system and located therein prior to said electrostatically charged cleaning brush so that said electrostatically charged cleaning brush is positioned in said system subsequent to said cleaning blade, said movable photoconductive belt being adapted to travel to said cleaning blade before said movable photoconductive belt contacts said subsequently positioned electrostatically charged cleaning brush, said cleaning blade adapted to scrape a partial amount of toner off said movable photoconductive belt and said movable photoconductive belt being lubricated by remaining toner prior to contacting said subsequently positioned brush, and said electrostatically charged cleaning brush being present in said system to remove charged toner from said movable photoconductive belt that was not previously removed by said cleaning blade, wherein said cleaning further comprises a vacuum unit for removing loosened toner from said movable photoconductive belt, and wherein said vacuum unit has at least two air flow channels, with one of said two air flow channels being in operative air flow vacuuming relationship with said electrostatically charged cleaning brush and another of said two air flow channels being in operative air flow vacuuming relationship with said cleaning blade.

2. The cleaning system of claim 1, wherein said electrostatically charged cleaning brush has a charge opposite a polarity to a toner used in said system and adapted to thereby remove toner from said photoconductive belt.

3. A system tor cleaning marking material from a surface portion of a movable photoconductive member, the movable photoconductive member moving past a first location and then a second location, comprising:

a blade, in engaging contact with the surface of the movable photoconductive member, for removing an amount of marking material from the surface portion of the movable photoconductive member, said blade being positioned at the first location and the amount of marking material removed with said blade being less than a total amount of marking material to be removed from the surface portion of the movable photoconductive member with the cleaning system;

a rotatable brush positioned at the second location and in interference contact with the movable photoconductive member, said rotatable brush removing substantially all residual marking material that was not removed by said blade; and a vacuum system, operatively associated with said blade and said rotatable brush, for removing any marking material loosened by said blade or said rotatable brush, wherein said vacuum system includes a first air flow channel and a second air flow channel, and wherein said first air flow channel is in operative vacuuming air flow relationship with said blade and said second air flow channel is in operative vacuuming airflow relationship with said rotatable brush.

4. The cleaning system of claim 3, further comprising an entry shield, wherein said entry shield is operatively positioned, relative to said blade, to capture loose marking material falling from said blade.

5. The cleaning system of claim 3, wherein said movable photoconductive member contacts said blade to provide toner contained lubrication to said blade.

6. The cleaning system of claim 3, further comprising a flicker bar for detoning said rotatable brush.

* * * * *